United States Patent [19]

Atkin et al.

[11] Patent Number: 4,613,050

[45] Date of Patent: Sep. 23, 1986

[54] BABY FEED BOTTLES

[76] Inventors: Edward Atkin, 4 Redington Road, London, NW3; Roger L. Williams, 5 Tudor Rise, Broxbourne, Hertfordshire, EN10 7HB, both of England

[21] Appl. No.: 654,726

[22] Filed: Sep. 27, 1984

[30] Foreign Application Priority Data

Feb. 1, 1984 [GB] United Kingdom ..... 8402664

[51] Int. Cl.[4] ..... A61J 9/00

[52] U.S. Cl. ..... 215/11 B

[58] Field of Search ..... 215/11 R, 11 B, 11 C, 215/11 D

[56] References Cited

U.S. PATENT DOCUMENTS

| | | | |
|---|---|---|---|
| 577,199 | 2/1897 | Neidlinger | 215/11 R |
| 1,510,571 | 10/1924 | Ware | 215/11 B |
| 1,998,646 | 4/1935 | Yager | 215/11 B |
| 2,569,139 | 9/1951 | Abelson | 215/11 R |
| 2,616,581 | 11/1952 | Madsen et al. | 215/11 B |
| 2,736,446 | 2/1956 | Raiche | 215/11 B |
| 3,113,569 | 12/1963 | Barr et al. | 215/11 R |
| 3,645,262 | 2/1972 | Harrigan | 215/11 R X |
| 3,746,198 | 7/1973 | Howland | 215/11 R |

FOREIGN PATENT DOCUMENTS

| | | | |
|---|---|---|---|
| 931443 | 10/1947 | France | 215/11 R |
| 987907 | 3/1965 | United Kingdom . | |
| 1345212 | 1/1974 | United Kingdom . | |

*Primary Examiner*—Donald F. Norton

*Attorney, Agent, or Firm*—Wolf, Greenfield & Sacks

[57] ABSTRACT

The invention provides a baby feed bottle and combination thereof with a screw fitting annular cap to which a teat, preferably moulded of liquid silicone rubber may be assembled before the cap is fitted to the bottle. The bottle is dimensioned with a large capacity per cm height, giving it an unusually large diameter, and the externally threaded neck (12) in particularly wide mouthed as it also has a large diameter of the order of three-quarters the diameter of the main portion (10) of the bottle. The teat is moulded with shape and dimensions such that, when the annular cap/teat subassembly is fitted to the bottle and screwed down, a flap valve arrangement is produced by a depending lip (35) on the teat which seals against the interior of the bottle neck. The flap valve arrangement is operative when the bottle is used to prevent collapse of the teat mouthpiece. (FIGS. 1, 4 and 6).

9 Claims, 15 Drawing Figures

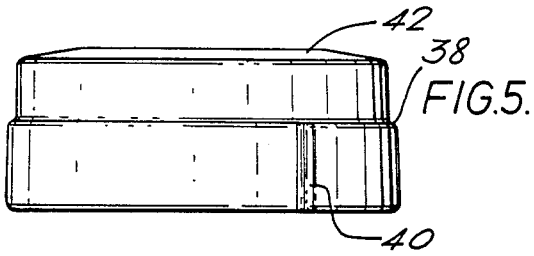
FIG.5.
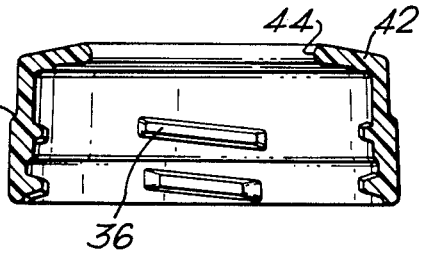
FIG.6.
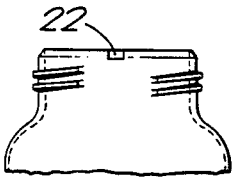
FIG.8A.
FIG.8B.
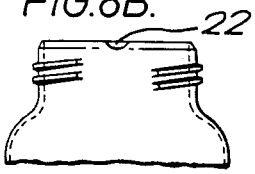
FIG.8C.
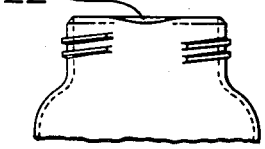

FIG.7A.
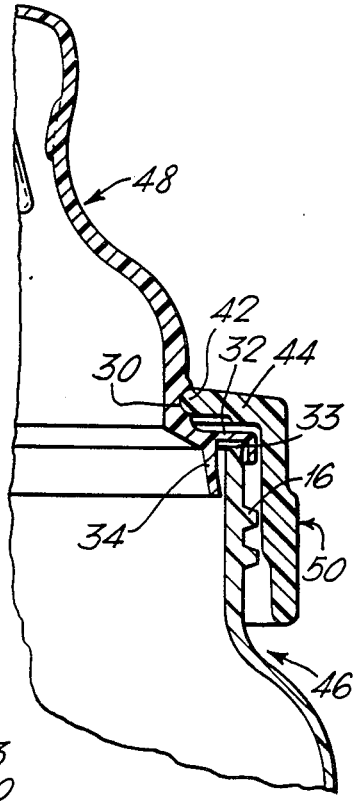
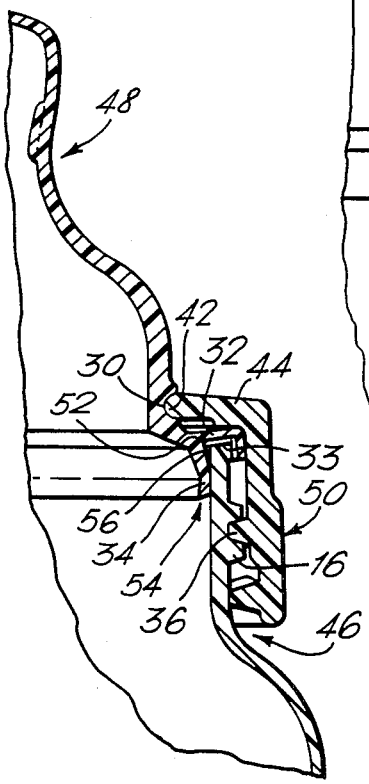
FIG.7B.

BABY FEED BOTTLES

This invention relates to a baby feed bottle and also to a baby feed bottle combination which comprises bottle, teat and teat fitting cap and may also include other components such as a dormal cap.

A present day baby feed bottle typically comprises a cylindrical necked bottle, a flanged teat, and an annular cap which screw fits to the bottle neck to attach the teat by pressing the teat flange against the rim of the bottle neck.

A typical bottle is relatively tall, having a capacity of the order of about 20 ml per cm height. This typical bottle therefore, having a neck portion above the bottle full mark of about 3 cm height will, in the case of a 250 ml full capacity bottle, stand about 15 cm high. Being of a diameter of the order of 5 cm, it thus tends to stand in a critically stable manner, and even a small disturbance is likely to knock or tip it over. This can lead to leakage of baby feed through the teat, and may create the need for re-sterilisation.

Additionally, although the neck diameter has been made as great as two thirds of the bottle main portion diameter, the neck is not large enough readily to enable insertion of food ingredients and thereby enable mixing in the bottle. Mixing, therefore, commonly has to be effected in another vessel, which also has first to be sterilised. Moreover, the relatively narrow neck can make it difficult to clean the bottle after use.

Another problem which can arise with the known bottle is that of teat collapse, especially in the case of the commonly preferred soft teat. This is due to the difficulty of letting air gain access into the bottle interior as the feed is sucked out through the teat. It is known to provide a radial groove or hole in the flange of the teat, but air first has to traverse the cooperating screw-threads between the annular cap and the bottle neck, and then may find the said radial groove at least partly closed or blocked, possibly because the cap has been screwed down too hard.

Yet again, shaking of the mixture in the bottle is only readily enabled by provision and fitting of a separate cap in place of the annular cap and teat, or at least a closure disc in place of the teat, since if the bottle with a fitted teat is shaken, feed is liable to be shaken out through the teat perforations or the teat valve system. Shaking of the mixture in the bottle can also lead to blockage of the radial groove in the teat flange, which must be kept clear to avoid the problem of teat collapse.

It is an object of this invention to provide a baby feed bottle and baby feed bottle combination which can provide a solution to the above described problems of the typical known bottle.

According to one aspect of the invention, there is provided a baby feed bottle having a main bottle portion surmounted by a neck portion at which a teat is attachable, the main portion having a capacity in the range 25 to 40 ml per cm height and the neck portion having a means cross sectional area not less than 0.4, preferably not less than 0.45, of the cross sectional area of the main portion. Preferably, the main bottle portion is generally tubular, conveniently cylindrical but other shapes are possible, the neck portion being cylindrical with a mean diameter not less than 0.65 of the body portion diameter.

The term "diameter" as used herein may be considered to refer in particular to the external diameter of the bottle portion in question; however, it will be understood that the thickness of the bottle material is relatively small and therefore that the stated limits can be considered equally applicable to the internal diameters.

The term "mean diameter" is used in relation to the main bottle portion because this portion may slightly depart from a true cylindrical shape; for example in a practical embodiment this bottle portion is marginally waisted to assist holding by the hand.

A preferred bottle has a capacity in the range 30 to 35 ml per cm height, and the neck has a mean diameter not less than 0.725 of the main portion diameter.

According to another aspect of the invention, a baby feed bottle has a main cylindrical portion with a mean diameter of not less than 6 cm and a neck portion diameter of not less than 4.25 cm.

It will thus be understood that the feed bottle in accordance with the invention, for a corresponding total capacity, is shorter and squatter than the known bottle. It therefore sits more stably when stood on its base, and is less liable to being tipped over. In addition, the wider neck facilitates the insertion of food ingredients, as by means of a scoop, and is more readily cleaned internally after use. Furthermore, a larger diameter neck enables the use of a larger teat, enabling use of the bottle by the baby more closely resembling natural feeding.

The use of a larger teat, however, more especially one moulded in a thin section of silicone rubber (SR) can lead to problems with the teat collapsing unless satisfactory means can be provided for maintaining normal pressure within the bottle when feed is sucked out through the teat.

According to another aspect of the invention, therefore, there is provided a baby feed bottle combination comprising a necked bottle, a flanged teat and an annular cap screw fitting to the necked bottle to attach the teat in postion by pressing the flange of the teat against the rim of the bottle neck, wherein the annular cap, teat and bottle neck are so formed that, when the cap is screwed down, the teat and bottle neck are caused to cooperate in the manner of a flap valve which is normally closed but is opened responsively to an air pressure reduction within the bottle, as when baby feed is sucked out through the teat.

The flap valve is preferably formed by a dependent annular lip on the teat flange, said lip normally fitting with small clearance inside the bottle neck, and the screwed down cap acting on the teat to deform the annular flange thereof so that the said lip is turned outwardly to engage the interior surface of the bottle neck, and said lip being sufficiently resilient to deform inwardly away from the interior surface of the bottle neck responsively to a pressure reduction in the bottle.

In a practical embodiment, the cap has an annular end face which at its internal peripheral rim seats in an external annular groove in the teat to locate and hold said teat relative to the cap, whereby the annular flange of the teat is deformed by the turning moment created, when the cap is screwed down, by the downward force acting on the teat at said internal peripheral rim and the upward reaction force acting on the teat at the rim of the bottle neck.

To allow passage of air past the flap valve into the bottle interior, the teat flange is preferably provided with at least one radial groove, the or each of which is located in the flange so that it bridges the rim of the bottle neck and allows air to pass from the exterior of the bottle to the interior however tightly the top is screwed down. Alternatively, the rim of the bottle neck may be provided with a groove extending from the exterior side to the interior side of the bottle. If desired, this groove in the bottle neck rim may have a profile enabling air flow control by adjusting the tightness of the screwed down cap. Desirably, to assist access of air to the said groove in the teat flange or in the bottle neck rim, the bottle neck and the cap cooperate through interrupted screwthreads.

Athough the above-described flap valve arrangement will ensure sealing at the joint between the bottle, teat and cap when the last mentioned is screwed down, it would still not be satisfactory to shake the bottle and contents if it remains possible for feed to be shaken out through the perforations in the mouthpiece of the teat.

Therefore, according to a still further aspect of the invention, there is provided a baby feed bottle combination comprising a necked bottle, a flanged teat, an annular cap screw fitting to the necked bottle to attach the teat in position by pressing the flange of the teat against the rim of the bottle neck, and a generally cup shaped dormal cap fitting to the end cap over a fitted teat, the teat and dormal cap being relatively dimensioned so that the fitted dormal cap seals the perforations on the mouthpiece end of the teat.

Preferably, the interior of the dormal cap is domed for cooperation with the end face of the mouthpiece of the teat, whilst the mouthpiece end of the teat is formed with a substantially flat perforated surface for cooperation with a flat on said dome.

In a practical embodiment, the open end portion of the dormal cap is formed with an internal rib which, when the dormal cap is push fitted into position, engages with the outside of the annular cap to prevent teat collapse due to the formation of a seal between said dormal cap and said annular cap, whilst the annular cap is formed with an external shoulder providing a stop for the open end of the dormal cap when the latter is push fitted. The said stop ensures that the mothpiece end of the teat is sealed by the domed interior of the dormal cap when the latter is pushed up against said shoulder, and yet the teat is not deformed.

A still further aspect of the invention concerns the teat per se, as used in the above-described baby feed bottle combination.

According to this still further aspect of the invention, a baby bottle teat, has a tip with a perforated end surface, a portion widening towards the other open end of the teat which fits to the feed bottle, an external annular flange at said open end, a lip depending from the flange inwardly of the outer periphery of the latter, and an external annular groove in the wall of the teat, said groove being located at a small axial spacing from the annular flange towards the mouthpiece.

The purpose of the external annular flange, the external annular groove and the depending lip will be clear from the preceding description of the baby feed bottle combination. Additionally, however, for ease of manufacture, the depending lip can have a radially outer wall surface which at its end portion is angled radially outwardly relative to the portion of said wall surface adjoining the annular flange. Furthermore, for fitting around the bottle rim outer periphery, the annular flange preferably carries an axially shorter depending lip or bead at its outer periphery.

Yet further aspects of the invention concern the combination of the bottle, more especially a polycarbonate bottle, dimensioned as aforesaid, with the above-described teat and the above-described annular cap and dormal cap, and also with a trainer spout which can be fitted to the bottle in place of the teat.

The invention will now be described by way of example with reference to a practical embodiment of baby feed bottle combination, also making reference to the accompanying drawings, in which:

FIG. 5 is an elevational view of an annular teat fitting cap;

FIG. 6 is an axial cross section through the cap;

FIGS. 7A and 7B are diagrammatic views for explaining the flap valve action of the bottle, teat and annular cap combination;

Figure 9:
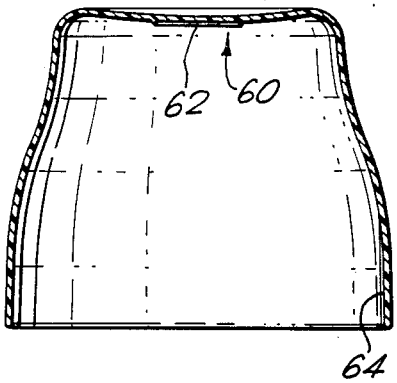
Figure 10:
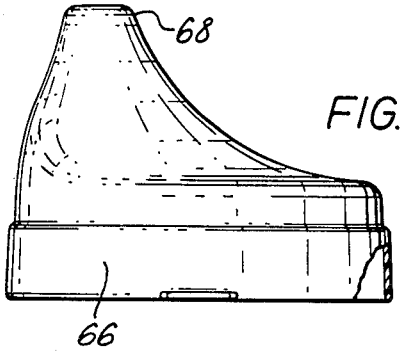

FIGS. 8A, 8B and 8C diagrammatically illustrate possible profiles for a groove in the rim of the bottle neck;

FIG. 9 is an axial cross section through a dormal cap;

FIG. 10 is a side elevational view of a cup trainer; and

Figure 11:
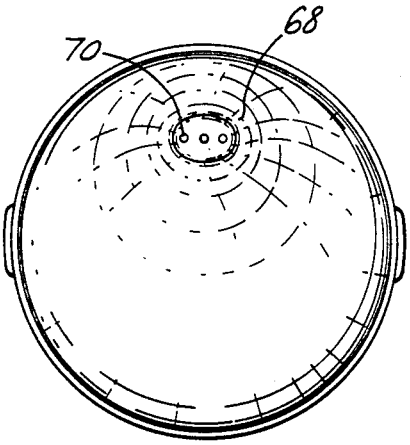

FIG. 11 is a plan view of a trainer spout.

Figure 1:
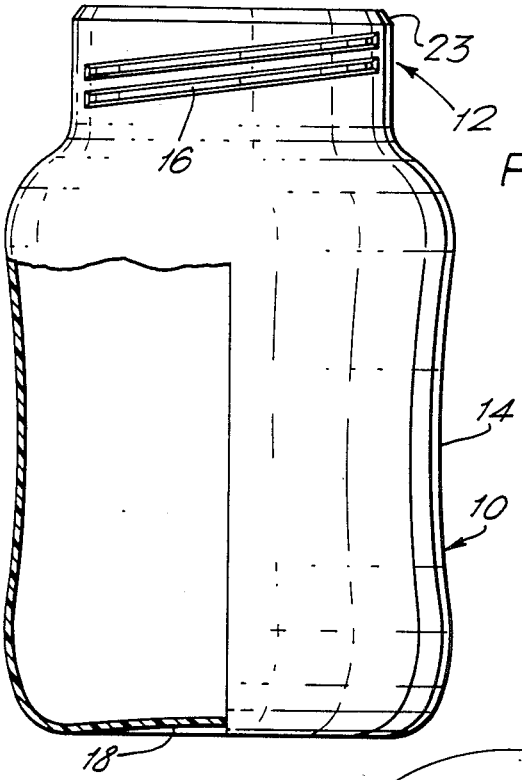
FIG. 1 is an elevational view of a baby feed bottle.
Figure 2:
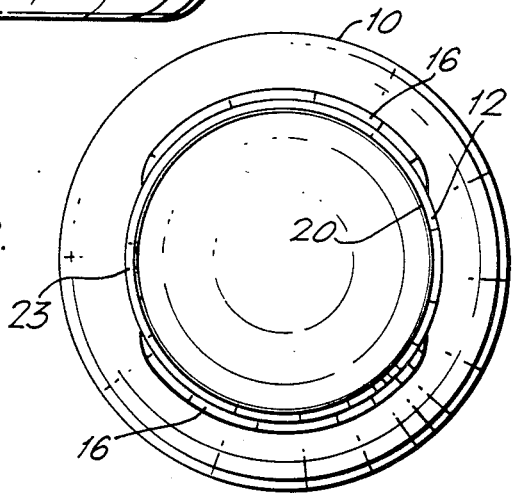
FIG. 2 is a plan view thereof.

The baby feed bottle shown in FIGS. 1 and 2 has a main portion 10 and a neck portion 12. Both portions are generally cylindrical, but the main portion is marginally waisted, as indicated at 14, to facilitate hand holding.

The neck has an interrupted screwthread 16 for receiving an annular teat fitting cap.

The bottle is made of clear polycarbonate and provided with graduated markings indicating capacity, for example up to a full capacity just at the top of the main portion 10 where it starts to merge into the neck portion 12 of reduced diameter.

The illustrated bottle, having a full capacity of 250 ml, is of a short, squat shape compared to a conventional feed bottle. Thus, the illustrated bottle has a main portion mean diameter of about 6.75 cm (7 cm maximum top and bottom to 6.5 cm at the centre of the waist) and main portion height up to the full capacity mark of about 8 cm. The neck portion diameter is about 5 cm. The total bottle height is about 12 cm.

More particularly, in accordance with the invention, the capacity per cm height lies between 25 to 40 ml per cm, in fact about 31 per cm, and a neck portion diameter of about 0.75 times the main portion mean diameter.

The base 18 of the bottle is slightly domed, convexly upwardly, whilst the rim 20 of the bottle neck is chamfered, as indicated at 23.

Figure 3:
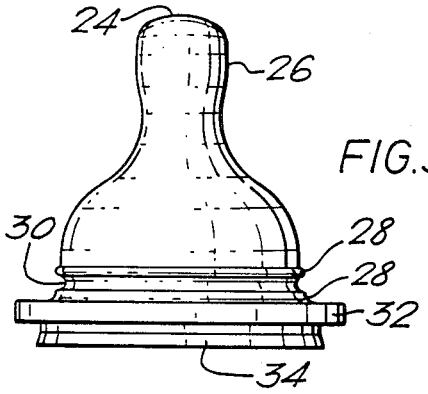
FIG. 3 is an elevational view of a teat.
Figure 4A:
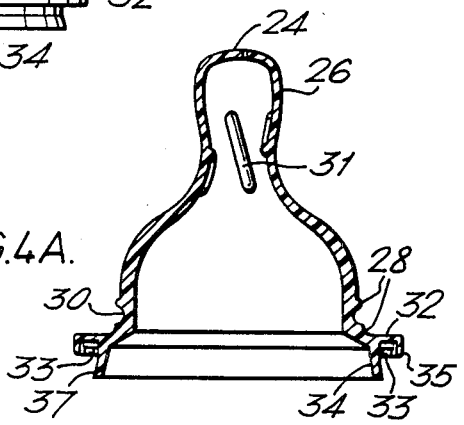
FIG. 4A is an axial cross section through the teat.
Figure 4B:
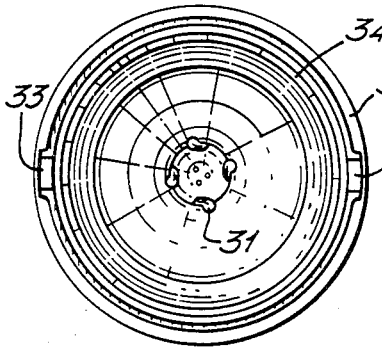
FIG. 4B is a plan view from below of the teat of FIG. 4A.

FIGS. 3 and 4 show the configuration of the moulded teat for use with the bottle of FIGS. 1 and 2, whilst FIGS. 5 and 6 shown an annular cap of polypropylene employed for fitting the teat to the bottle.

The teat has a nearly flat or very shallowly curved surface 24 at the end of the mouthpiece 26; the teat perforations are formed in this end surface. Below the mouthpiece the teat widens out to a pair of spaced external ribs 28 which define an annular groove 30 between them, immediately above an annular flange 32. The flange 32 has an inner depending annular lip 34, and an outer axially shorter, shaped depending bead or lip 35. The reference 31 denotes inclined inwardly directed stiffening ribs formed in the side wall of the mouthpiece of the teat.

The flange is dimensioned to seat on the rim 20 of the bottle neck, with the inner lip 34 extending into the interior of the bottle neck with small clearance from the interior surface of the latter. The bead 35 fits around the bottle neck on the chamfered rim 23 and the two diametrically opposed recesses or grooves 33 formed in the undersurface of the flange 32 bridge the top of the rim 23 to allow air to pass from the exterior to the interior of the bottle (see FIGS. 4A and 4B).

In practice, however, the teat is attached to the annular cap of FIGS. 5 and 6 before being fitted to the bottle.

The annular cap has an internal interrupted screwthread 36 for screwing to the externally threaded bottle neck, and externally the cap is shouldered at 38, being provided with an enlargement 40 on the wider diameter portion below the shoulder. The enlargement 40 facilitates the screwing and unscrewing of the cap.

The cap, in addition to its internally threaded cylindrical wall, has an annular end wall 42 of which the interior peripheral rim 44 is dimensioned to fit into the external annular groove 30 on the teat. The teat and annular cap can thus be press fitted together, so that the cap then locates the teat and the two can be fittted as a sub-assembly to the bottle.

FIGS. 7A and 7B are now referred to for facilitating understanding of the manner in which the bottle, teat and annular cap cooperate with one another when the cap and teat sub-assembly is screwed into position. In these two figures, the bottle neck is generally referenced 46, the teat 48 and annular cap 50. The previously described features of these three components are referenced in accordance with the preceding description.

FIG. 7A shows the annular cap 50 (which carries the teat 48) screwed loosely on to the bottle neck. The teat flange 32 and inner depending lip 34 are undistorted, with the lip 34 spaced with small radial clearance within the neck of the bottle.

FIG. 7B shows the effect of tightening the cap/teat subassembly by screwing the cap further on to the bottle neck. The annular flange 32 is deformed downwardly at its inner end region 52 due to the downward pressure exerted on the teat by the inner peripheral rim 44 of the annular end wall 42 of the cap 50, where this rim is engaged into the external annular groove 30 on the teat. In consequence, the inner depending lip 34 is turned radially outwardly to engage and seal with the interior wall of the bottle neck, as indicated at 54. An axial advance of the cap 50 by about 2 mm is sufficient to deform the teat from the FIG. 7A condition to the FIG. 7B condition.

The manner in which the depending lip 34 acts as a flap valve, in use of the bottle by a baby, can also be visualised from FIG. 7B. External air pressure exists on the radially outer side of the lip, in the space 56, due to free passage of air past the interrupted screwthreads 16, 36 and the radial grooves 33 in the teat flange 32. Consequently, if pressure in the bottle tends to fall due to feed being sucked out through the teat, the lip 34 is deformed inwardly away from the inside of the bottle neck wall, i.e. opening in the manner of a flap valve to let air into the bottle. This minimises risk of teat collapse, even with the relatively large teat of this invention. The flap valve closes again when the pressure in the bottle has equalised to the pressure outside.

The efficiency of the flap valve action is assisted by the angling of the end portion of the radially outer wall surface of the depending lip 34, as indicated at 37 in FIG. 4, since this helps to ensure that the seal is effected around a circular lines, as distinct from a circular band.

The use of silicone rubber as the teat material is preferred in the context of the above-described flap valve arrangement, because whereas a teat of conventional rubber tends to "grow" as it ages, a silicone rubber teat has a much reduced tendency to do so with the result that its critical shaping and dimensioning is retained throughout the life of the teat.

FIGS. 8A to 8C show three possible differing profiles for a radial groove 22 in the rim of the bottle neck instead of providing one or more groove 33 in the teat flange 32. The shallow but wide concave profile of FIG. 8C enables air flow to be controlled by adjusting the tightness of the cap, within the range of tightness which ensures that a seal is made in the manner of FIG. 7B.

FIG. 9 shows a dormal cap which push fits over the teat around the annular cap. This dormal cap, at its closed end, has a domed interior 60 having a central flat 62, and at a portion adjacent its open end, has an internal longitudinal bead 64. The dormal cap can be moulded of polypropylene.

The dormal cap is dimensioned to push fit over the annular teat fitting cap until its rim abuts against the external shoulder 38 on the annular cap, whereby, in this position, the central flat 62 on the dome 60 engages against the perforated, almost flat, end surface 24 of the teat to seal the perforations against egress of the bottle contents. It is thereby possible, when the dormal cap is fitted over the teat, to shake the bottle without loss of the baby feed inside, and without the necessity first to replace the teat by a closure disc or the like. The bead 64 prevents a seal being formed between the dormal cap and the annular cap when the dormal cap is push fitted thus preventing teat collapse due to a build up of pressure as the dormal cap is pushed fully down into its home position.

The manner of use of the above-described baby feed bottle combination can be as follows:

(a) all the components are sterilised;

(b) the annular cap and teat are assembled, and the dormal cap is preferably also push fitted to form part of the sub-assembly. This prevents further contact with the sterilised teat;

(c) the bottle is filled with baby feed and, if desired, this feed mixture can be prepared in the bottle;

(d) the sub-assembly of (b) is screwed with a relatively light pressure on the bottle neck but sufficiently to make a seal by deformation at the open end of the teat;

(e) the bottle is shaken;

(f) the dormal cap is removed. The bottle is now ready for use.

It will also be appreciated that the bottle filled with baby mix, and having the dormal cap fitted over the teat, is very convenient for travel, in a condition ready for immediate use when required.

The annular cap may, of course, be screwed on to the bottle without a fitted teat. FIGS. 10 and 11 show a trainer spout which can be push fitted over the screwed on annular cap, when the teat is omitted.

The trainer spout has a rim portion 66 at its open end which is stopped against the shoulder 38 on the annular cap when the trainer is push fitted into position. It also has an upstanding eccentric spout 68 having small apertures 70 in its end through which baby feed can be taken by a baby with a sucking and/or drinking technique. The spout can also be moulded of polypropylene.

It will be appreciated that various modifications of the above-described arrangements of bottle, teat, screw cap and other components are possible, within the scope of the invention as defined by the appended claims. For example, the dormal cap could screw fit into position on an externally threaded annular cap, and the trainer spout could screw fit either on to said externally threaded annular cap or possibly directly on to the bottle neck.

Within the dimensional limits stated, the bottle may be produced in several sizes of differing total capacities, including a small size in which the main portion diameter may exceed the height of the bottle. As far as the teat is concerned, a flat or nearly flat perforated end surface is not essential, but is preferred to assist sealing by the dormal cap without deformation of the teat mouthpiece. However, it would be possible to dome the interior of the dormal cap in any convenient manner matching the shape of the said end surface of the teat mouthpiece. The ability to sub-assemble the annular cap and the teat as an initial step is not an essential requirement, but it is important that the annular cap when screwed down should act on the teat on a circle radially smaller than the rim of the bottle neck, thereby to create the necessary turning moment which in turn results in creation of the flap valve arrangement, as the latter is important to avoid collapse of the teat mouthpiece when feed is sucked out of the bottle, this in turn being especially important when a large moulded silicone rubber teat is employed.

We claim:

1. A teat for a baby feed bottle, said teat having a mouthpiece with a perforated end surface, a portion widening towards the other open end of the teat which fits to the feed bottle, an external annular flange at said open end, with at least one groove adapted to permit the passage of air from the exterior to the interior of a baby feed bottle when fitted to the rim of the neck thereof, a lip depending from the flange inwardly of the outer periphery of the latter, and an external groove in the wall of the teat, said groove being located at a small axial spacing from the annular flange towards the mouthpiece and radially inwardly of the lip.

2. A teat according to claim 1, moulded of silicone rubber.

3. A teat according to claim 1, wherein the external groove is annular and positioned between two external ribs on the wall of the teat, the one rib adjoining the annular flange.

4. A teat according to claim 1, wherein the depending lip has a radially outer wall surface which at its end portion is angled radially outwardly relative to the portion of said wall surface adjoining the annular flange.

5. A teat according to claim 1, wherein the annular flange carries an axially shorter depending lip at its outer periphery.

6. In combination with a teat according to claim 1, a baby feed bottle having a main bottle portion and a neck portion surmounting said main portion and at which a teat is attachable, the main portion having a capacity in the range 25 to 40 ml per cm height and the neck portion having a mean cross sectional area not less than 0.4 of the cross sectional area of the main portion.

7. The combination according to claim 6, wherein the main bottle portion has a capacity in the range 30 to 35 ml per cm height, and the neck portion has a mean diameter not less than 0.725 of the main portion diameter, the main bottle portion mean diameter being not less than 6 cm.

8. The teat as claimed in claim 1 in combination with a necked bottle and an annular cap screw-fitting to the necked bottle to attach the teat in position by pressing the flange of the teat against the rim of the bottle neck, said lip normally fitting with small clearance inside the bottle neck, the screwed down cap having means acting on the teat to deform the annular flange thereof so that the said lip is turned outwardly to engage the interior surface of the bottle neck and form a seal therewith, and said lip being sufficiently resilient to deform inwardly away from the interior surface of the bottle neck to break the seal responsively to a pressure reduction in the bottle as when baby feed is sucked through the teat.

9. The combination of claim 8 wherein the cap has an annular end face with an internal peripheral rim which seats in the external annular groove in the wall of the teat to located and hold said teat relative to the cap, the annular flange of the teat being deformed by the turning moment created, when the cap is screwed down, by the downward force acting on the teat at said internal peripheral rim and the upward reaction force acting on the teat at the rim of the bottle neck.

* * * * *